US006122457A

United States Patent [19]

Kizaki

[11] Patent Number: 6,122,457

[45] Date of Patent: Sep. 19, 2000

[54] IMAGE FORMING APPARATUS AND CONTROL ARRANGEMENT FOR SEMI-AUTOMATIC DOCUMENT FEEDING

[75] Inventor: Osamu Kizaki, Saitama, Japan

[73] Assignee: Ricoh Company, Ltd., Tokyo, Japan

[21] Appl. No.: 09/288,283

[22] Filed: Apr. 8, 1999

[30] Foreign Application Priority Data

Apr. 8, 1998 [JP] Japan ..... 10-095941

[51] Int. Cl.[7] ..... G03G 21/00

[52] U.S. Cl. ..... 399/11; 399/15; 399/82

[58] Field of Search ..... 399/11, 15, 82

[56] References Cited

U.S. PATENT DOCUMENTS

| | | | |
|---|---|---|---|
| 4,448,515 | 5/1984 | Ishikawa | 399/11 X |
| 4,451,137 | 5/1984 | Farley . | |
| 5,555,099 | 9/1996 | Telle | 399/15 |

FOREIGN PATENT DOCUMENTS

| | | |
|---|---|---|
| 2-304461 | 12/1990 | Japan . |
| 8-95436 | 4/1996 | Japan . |
| 8-248831 | 9/1996 | Japan . |
| 10-4467 | 1/1998 | Japan . |

*Primary Examiner*—Quana M. Grainger

*Attorney, Agent, or Firm*—Oblon, Spivak, McClelland, Maier & Neustadt, P.C.

[57] ABSTRACT

An image forming apparatus operable in a trial copy mode before a usual copying operation is disclosed. The apparatus includes a trial copy mode section for executing the trial copy mode for forming a document image on a recording medium in set conditions at least once and discharging it to a preselected destination. An automatic document feeding section is positioned above a glass platen mounted on the apparatus body for automatically feeding a document to the glass platen. A first copy starting section includes a start key for commanding the start of a copying operation or a trial copy key for commanding the execution of the trial copy mode. A second copy starting section determines, in response to a copy start command output from the first copy starting section, whether or not the document set on the automatic document feeding section is a single document and executes, if it is a single document and when the next document is set, an SADF (Semi Automatic Document Feeder) mode for starting copying the next document even if the start key is not pressed. A copy start control section selectively executes, in response to the copy start command and even if the document set on the automatic document feeding section is a single document, the start of the SADF mode of the second copy starting section or the inhibition of the SADF mode.

5 Claims, 13 Drawing Sheets

| Fig. 5A | Fig. 5B |
|---|---|

START
NEW JOB INPUT ?
NO
YES
S1
SET NEW MODE (RESET fSadf)
S2
S3
fSadf SET ?
YES
NO
S4
VALIDATE TRIAL COPY KEY
S17
INVALIDATE TRIAL COPY KEY

IMAGE FORMING APPARATUS AND CONTROL ARRANGEMENT FOR SEMI-AUTOMATIC DOCUMENT FEEDING

BACKGROUND OF THE INVENTION

The present invention relates to a copier or similar image forming apparatus and more particularly to an image forming apparatus operable, before a usual copying operation, in a trial copy mode for allowing the operator to confirm copying conditions and image quality.

A copier or similar image forming apparatus operable in an SADF (Semi Automatic Document Feeder) mode in addition to an ADF mode and a finisher mode is conventional. In the SADF mode, if a single document is set on an ADF, as determined after the output of a copy start command, a copy start command meant for the next document set on the ADF after the above document is automatically output without requiring the operator to press a start key. The SADF mode is successful to promote easy operation of the apparatus.

A trial copy mode for producing a single trial copy has also been customary with the above copier. The trial copy allows the operator to see the quality of an image before a plurality of copies are actually output. Specifically, even when the desired number of copies input on the copier is two or more, the copier does not produce all of the copies at a time, but produces only a single trial copy and discharges it to a preselected tray. The operator can therefore see the quality of the trial copy and cause, if it is acceptable, the copier to produce the desired number of copies continuously without any defective copy.

A modification of the trail copy mode is such that the operator causes the copier to produce a trial copy with a simplex document carrying an image on one side thereof in a simplex-to-simplex mode and replaces, if the trial copy is acceptable, the simplex-to-simplex mode with a simplex-to-duplex mode.

Japanese Patent Laid-Open Publication No. 8-87205, for example, discloses an image forming apparatus operable in the trail copy mode (Prior Art 1 hereinafter). Prior Art 1 teaches a specific arrangement having at least a stapling function and including stapler control means for selectively inhibiting a stapling operation when a single paper or similar recording medium is used or canceling the inhibition. Another specific arrangement has a trial copying function for forming a document on a paper in a set mode at least once and discharging the paper to a preselected destination and a stapling function, and includes operating means for adjusting a stapling position at the time of trial copying. Still another specific arrangement also has the trial copying function and stapling function and includes operating means for adjusting a stapling position at the time of trial copying and stapler control means causing the operating means to staple a single trial copy. A further specific arrangement has the trial copying function and a sorting and stapling function and includes stapler control means for replacing, at the time of stapling of a trial copy, if papers are present in the bins of a sorter, the bin for each trial copy and inhibiting, when the number of empty bins becomes short of the desired number of copies, usual copy processing.

Prior Art 1 extends the trial copying function, i.e., allows the stapling of a single paper customarily inhibited to be executed in the trial copy mode, thereby enhancing easy and efficient operation. Specifically, the stapler control means inhibits, in the usual copy mode, a single paper from being stapled, but allows it to be stapled in the trial copy mode.

This obviates the waste of papers at the time of adjustment of the stapling position and obviates the need for the stapling of a single paper in the usual copy mode.

The operating means of Prior Art 1 allows the stapling position to be adjusted in the trail copy mode and thereby promotes easy adjustment of stapling. In the trial copy mode with stapling, the stapler control means allows even a single paper to be stapled in order to obviate the waste of papers. Also, when papers are present in the bins of the sorter, the stapler control means replaces the bin for each trial copy and thereby makes it needless to remove the papers existing in the bins. Further, when the number of empty bins becomes short of the desired number of copies, the stapler control means inhibits the usual copying operation. The operator can therefore obtain trial copies without regard to the number of empty bins.

Japanese Patent Laid-Open Publication No. 8-248831 (Prior Art 2 hereinafter) proposes an image forming apparatus also operable in the trial copy mode for forming a document image on a paper in set conditions at least once and discharging the paper to a preselected destination. Prior Art 2 includes a trial copy key for executing a trial mode operation, means for determining whether or not to accept an input on the trial copy key, a usual copy key for executing a usual copy mode operation, means for determining whether or not to accept an input on the usual copy key, and input control means for invalidating the trial copy key and usual copy key during trial copying, but validating them when a trial copy is discharged.

Invalidating the trial copy key and usual copy key during trail copying, as stated above, successfully prevents the operator from starting the next copying operation before confirming image quality. In addition, in the usual copy mode, the next copy is produced as soon as a paper is fed. This renders the copying operation efficient.

However, Prior Art 1 and Prior Art 2 each bring about the following problems when the trial copy mode and SADF-mode are combined. Assume that a trial copy is produced from a single document set on the ADF in the SADF mode in the same manner as in the usual copy mode. Then, the apparatus produces a trial copy with the single document and then waits for the next document in the SADF mode. As a result, when the next document is set on the ADF, the apparatus outputs a copy start command in the SADF mode and starts copying the next document in the usual copy mode before the end of the trial copy mode. This makes the trial copy practically meaningless.

Moreover, the trial copy mode taught in each of Prior Art 1 and Prior Art 2 is such that a document used to produce a trial copy is not left on the glass platen, but driven out of the apparatus. Therefore, when the operator again sets the document on the ADF, the apparatus automatically starts copying it. Consequently, should the operator forget to alter the image forming conditions after trial printing and again set the document on the ADF, a defective copy would be produced in the existing image forming conditions.

Technologies relating to the present invention are also disclosed in, e.g., Japanese Patent Laid-Open Publication Nos. 2-304461, 8-95436, and 10-4467.

SUMMARY OF THE INVENTION

It is therefore an object of the present invention to provide an image forming apparatus operable in a trial copy mode and an SADF mode and capable of setting a mode accurately and obviating defective copies.

In accordance with the present invention, an image forming apparatus includes a trial copy mode and section for executing the trial copy mode for forming a document image on a recording medium in set conditions at least once and discharging it to a preselected destination. An automatic document feeding section is positioned above a g lass platen mounted on the apparatus body for automatically feeding a document to the glass platen. A first copy starting section includes a start key for commanding the start of a copying operation or a trial copy key for commanding the execution of the trial copy mode. A second copy starting section determines, in response to a copy start command output from the first copy starting section, whether or not the document set on the automatic document feeding section is a single document and executes, if it is a single document and when the next document is set, an SADF (Semi Automatic Document Feeder) mode for starting copying the next document even if the start key is not pressed. A copy start control section selectively executes, in response to the copy start command and even if the document set on the automatic document feeding section is a single document, the start of the SADF mode of the second copy starting section or the inhibition of the SADF mode. Alternatively, the apparatus may include a control section for inhibiting, while the SADF mode is under way, the acceptance or the execution of the trial copy mode using the first copy starting section.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
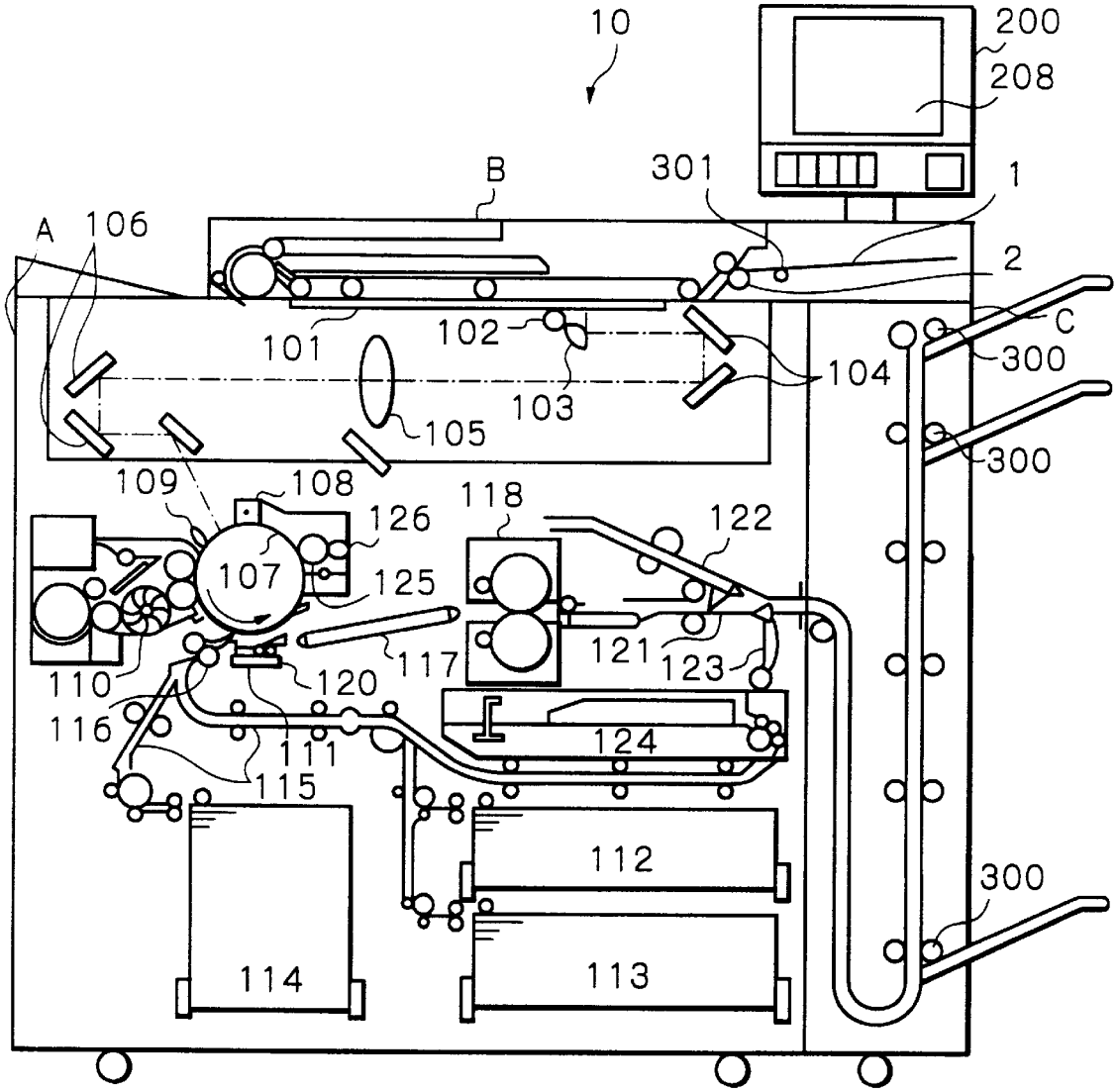
FIG. 1 is a view showing an image forming apparatus embodying the present invention.

Referring to FIG. 1 of the drawings, an image forming apparatus embodying the present invention is shown and implemented as a copier by way of example. As shown, the copier, generally 10, includes hardware generally made up of a copier body A, an ADF B, and a sorter C.

The ADF B includes a tray 1 for stacking documents. A pick-up roller 2 feeds the documents from the tray 1 toward a glass platen 101 one by one. The document brought to the glass platen 101 is brought to a stop there. A document sensor 301 determines whether or not documents are present on the tray 1. The document sensor 301 may be implemented by a conventional transmission type or a reflection type optical sensor. An operating section 200 has hardware mainly consisting of keys for inputting desired copying conditions and a display 208 for displaying the copying conditions, guidance and so forth, as will be described in specifically later.

A fluorescent lamp, halogen lamp or similar light source 102 illuminates the document brought to the glass platen 101. The resulting imagewise reflection from the document is routed through optics including a first mirror 103, a second mirror 104, a through lens 105 and athirdmirror 106 to a photoconductive element 107 having been uniformly charged by a main charger 108. As a result, a latent image representative of the document is electrostatically formed on the drum 107.

After an eraser 109 has erased needless charge deposited on the drum 107, a developing unit 110 develops the latent image to thereby produce a corresponding toner image. A transfer charger 111 transfers the toner image from the drum 107 to a paper or similar recording medium. After the paper with the toner image has been separated from the drum 107, a discharger 125 discharges the drum 107, and then a cleaning unit 126 removes toner left on the drum 107.

Specifically, a paper is fed from a paper tray 112, 113 or 114 or a duplex copy tray 124 to a registration roller 116 along a transport path 115. The registration roller 116 drives the paper to a nip between the drum 107 and the transfer charger 111 in synchronism with the rotation of the drum 107 carrying the toner image thereon. After the transfer charger 111 has transferred the toner image from the drum 107 to the paper, a separation charger 120 separates the paper from the drum 107. A belt 117 conveys the paper separated from the drum 107 to a fixing unit 118. The fixing unit 118 fixes the toner image on the paper.

In a duplex copy mode, a path selector 121 is switched to select a duplex copy path 123 and steers the paper carrying the toner image on one side thereof to the duplex copy tray 124. This paper, or simplex copy, is again fed from the duplex copy tray 124 and subjected to the above procedure to turn out a duplex copy.

When a toner image is to be transferred to the rear of the above paper or in a simple copy mode, the path selector 121 is operated to steer the paper to the sorter C. At the time of image transfer to the rear of the paper, the paper is turned over by a turning section 122 and then driven out to the sorter C. The paper is introduced into preselected one of bins included in the sorter C. After papers equal in number to the desired sets of copies have been distributed to the consecutive bins, the next paper is again introduced into the first bin. Such a procedure is repeated until the desired number of sets of copies have been stacked on the consecutive bins.

The copier 10 is selectively operable in a stack mode for stacking a desired number of papers, i.e., copies produced with a single document on the same bin or a sort mode for distributing such copies to the consecutive bins in the above-described manner.

Copy sensors 300 each are associated with the respective bin of the sorter C for determining that the paper has been driven out of the copier body A. The output of each copy sensor 300 remains in an ON state while the paper is passing by the sensor 300. Therefore, the output of the sensor 300 shows that the paper has been fully driven out of the copier body A when it goes OFF.

Figure 2:
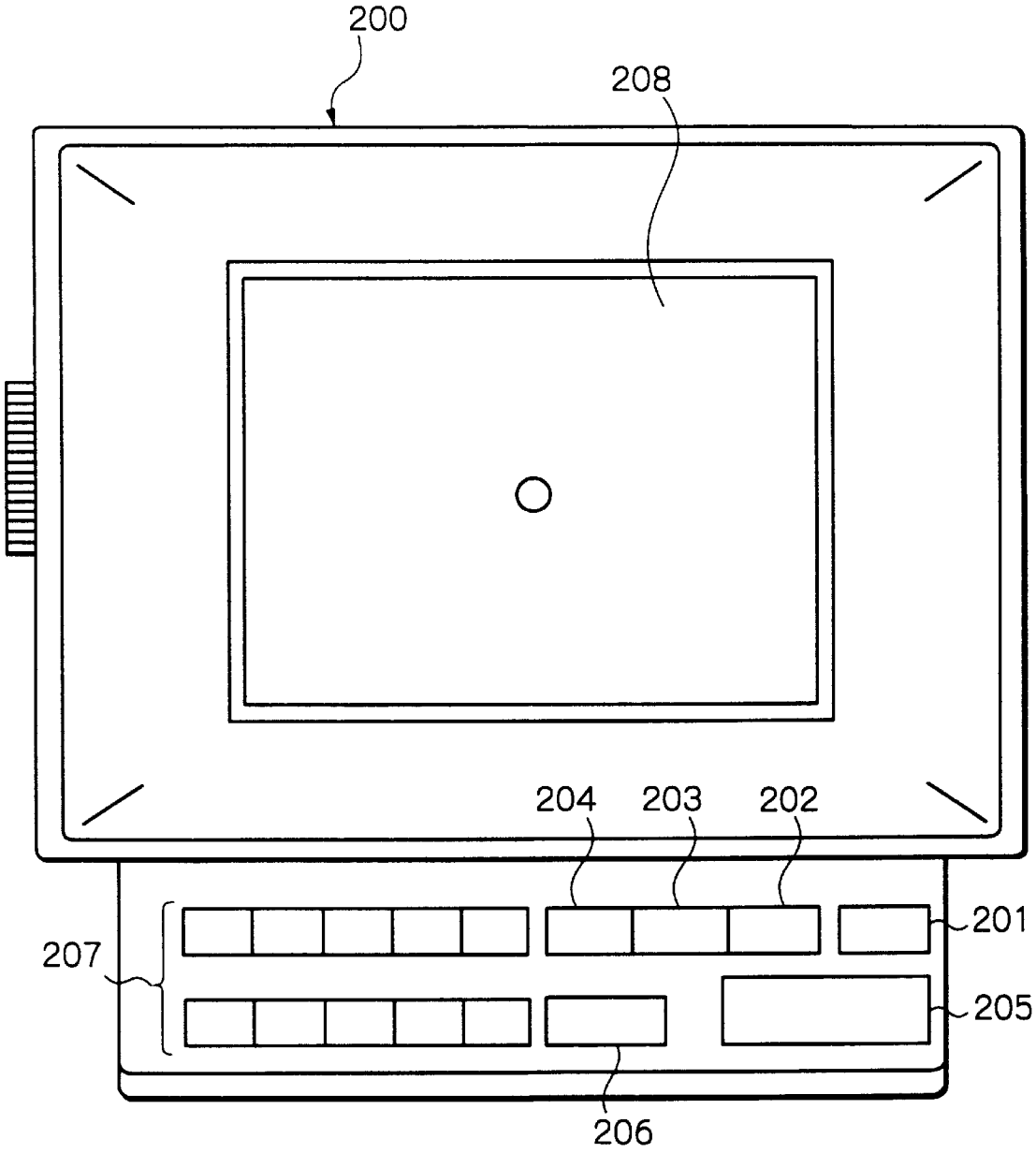
FIG. 2 is a front view showing a specific configuration of an operating section included in the illustrative embodiment.

Reference will be made to FIG. 2 for describing the operating section 200. As shown, the operating section 201 includes a mode clear key 201 for returning all the modes available with the copier 10 to standard statuses.

Specifically, when the mode clear key 201 is pressed, there are set up a single copy, automatic image density, automatic paper feed, and ×1 magnification; all the other functions including the duplex copying function are cancelled.

An interrupt key 202 is used to interrupt the copying operation of the copier 10 in order to produce other copies. A program key 203 allows the user of the copier 10 to register modes to use frequently and to call the registered modes. A guidance key 204 is used to see information showing a basic operating procedure or basic functions available with the copier 10 on the display 208. A start key 205 causes the copier 10 to start operating when pressed. In addition, the start key 205 shows the operator whether or not the copier 10 is usable. Specifically, a green LED (Light Emitting Diode) and a red LED are arranged on the rear of the start key 205; the former turns on when the copier 10 is usable while the latter turns on when it is not usable.

A clear/stop key 206 may be pressed to clear the number of copies while the copier 10 is in its stand-by state or to interrupt the copying operation while the copier 10 is in operation. Numeral keys 207 allow the operator to input various numerical values including the desired number of copies, zoom magnification, and margins.

The display 208 is implemented by a CRT (Cathode Ray Tube) and shows the previously mentioned information thereon. A touch panel, not shown, is arranged on the front of the CRT 208, so that the operator can select desired conditions by touching it.

Figure 3:
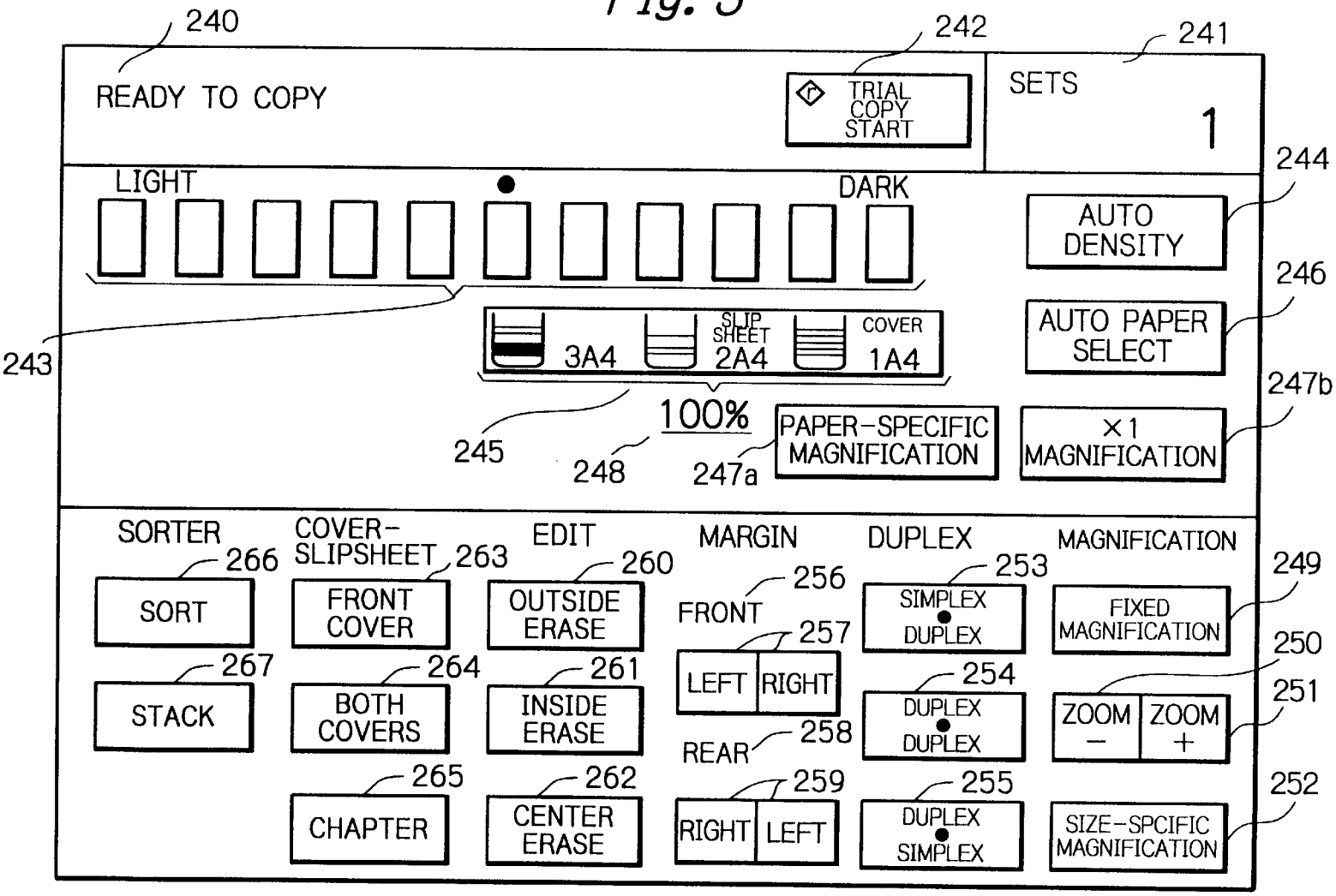
FIG. 3 is a view showing a specific picture to appear on a display included in the operating section of FIG. 2.

FIG. 3 shows a specific picture, i.e., specific information appearing on the display 208. As shown, the display 208 includes a message area 240 for displaying a message relating to the status of the copier 10, e.g., "Ready to copy" or "Copying". An area 241 shows the desired number of copies input on the numeral keys 207. A trial copy start key 242 causes the copier 10 to produce a trial copy when touched by the operator. When trial copying is inhibited, the trial copy start key 242 does not appear on the display 208 or is invalidated when touched by the operator.

Density keys 243 allow the operator to manually select a desired image density. An auto density key 244 automatically adjusts image density on the basis of the background density of a document when touched by the operator. An area 245 displays paper sizes, remaining amounts of papers, and kinds of papers and allows the operator to select a desired paper tray. An auto paper select key 246 automatically determines a document size and selects a particular tray loaded with papers of optimal size based on the document size and a desired magnification. A paper-specific magnification key 247*a* is touched to cause the copier 10 to automatically enlarge or reduce adocument image in accordance withthe desired paper size (e.g. A4 or B5). A ×1 magnification key 247*b* is touched to select ×1 magnification. An area 248 shows a magnification.

A fixed magnification key 249 is touched to enlarge or reduce a document image in a fixed size. Zoom keys 251 are used to select a magnification on a 1% basis (e.g., 101%, 102%, 103%, 104%, 105% and so forth). A size-specific magnification key 252 is used to enlarge or reduce a document image to a desired size. A magnification selected on the key 252 appears on the area 248. A simplex→duplex key 253, a duplex→duplex key 254 and a duplex→simplex key 255 are respectively used to copy a simplex document on both sides of a paper, to copy a duplex document on both sides of a paper, and to copy a duplex document on one side of a paper.

An area 256 displays the dimension of a front binding margin selected on a right or a left key 257. An area 258 displays the dimension of a rear binding margin selected on a right or a left key 259.

An outside erase key 260, an inside erase key 261 and a center erase key 262 allow the operator to edit a document image. The outside erase key 260 and inside erase key 261 are respectively used to erase the inside and the outside of a marked area of a document image. The center erase key 262 is used to erase the center of a document image, e.g., the image of a spread book document.

A front cover key 263 is used to copy the first document page on an exclusive paper for covers. A both cover key 264 is used to copy the first and last document pages on the exclusive papers. A chapter key 265 is used to copy a desired document page on a slipsheet. There are also shown in FIG. 3 a sort key 266 and a stack key 267.

Figure 4A:
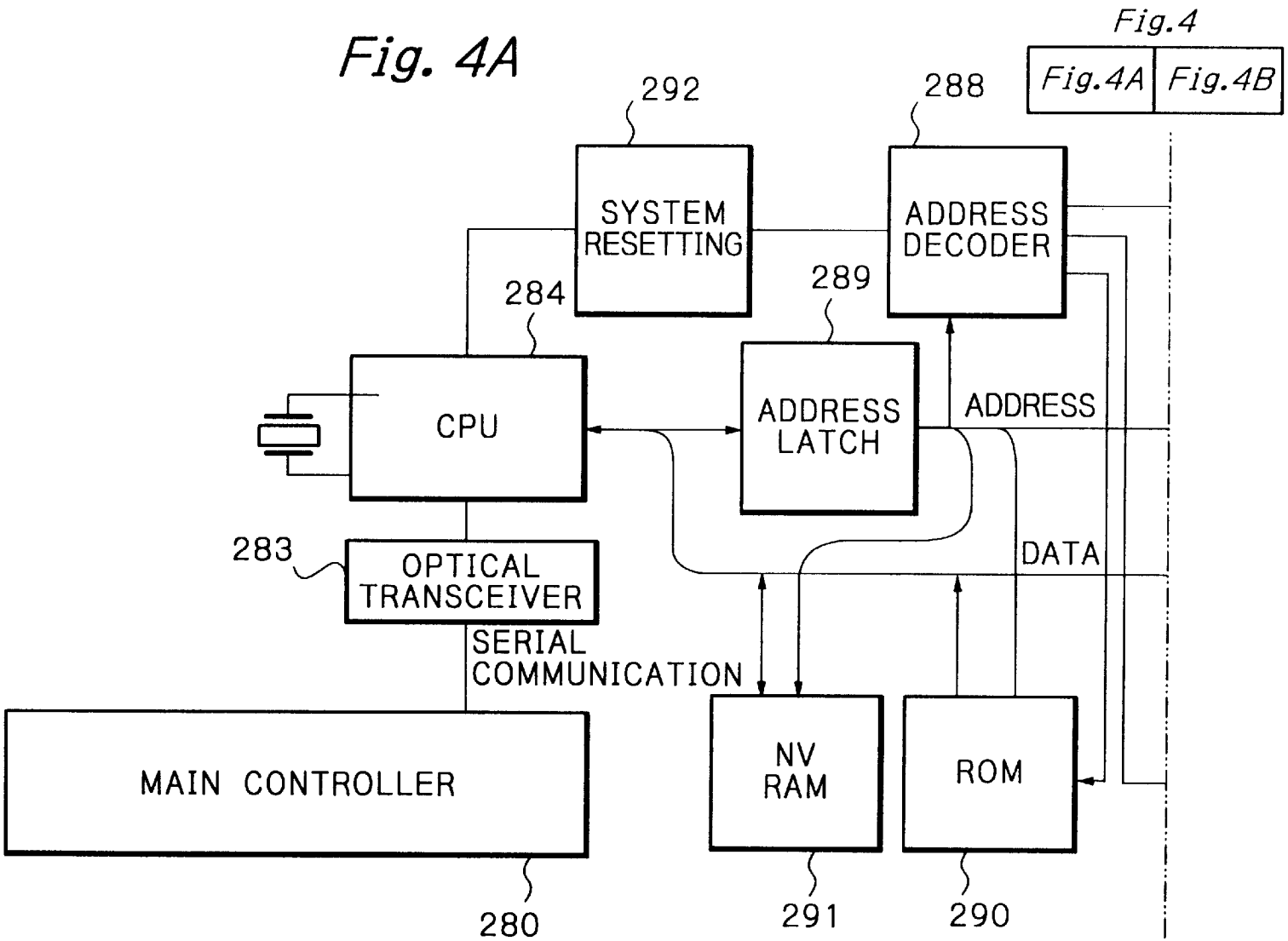
FIG. 4 is a block diagram schematically showing control circuitry included in the illustrative embodiment.
Figure 4B:
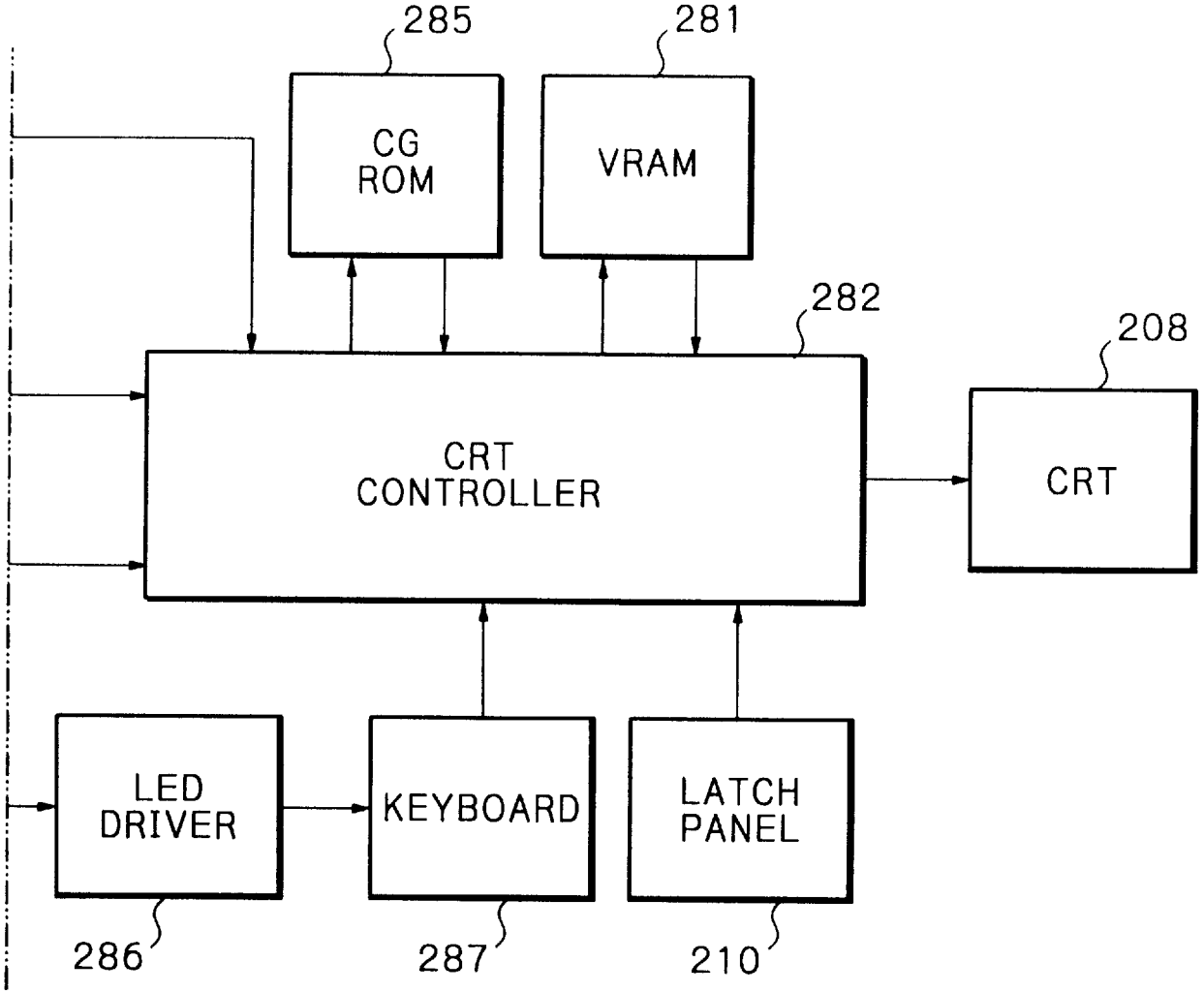

FIG. 4 shows control circuitry included in the operating section 200. As shown, the control circuitry includes a main controller 280 for controlling the entire copier 10, particularly a trial copying function which will be described specifically later. A CPU (Central Processing Unit) 284 interchanges commands with the main controller 280 via an optical transceiver 283 by serial communication. On receiving a command from the main controller 280, the CPU 284 displays information on the CRT 208 via a CRT controller 282.

A VRAM (Volatile Random Access Memory) 281 has a bit pattern area divided into some subareas and is capable of storing a bit pattern representative of a picture different from a picture being displayed. By varying the addresses of the VRAM 281, it is possible to change the picture in a moment. The CRT controller 282 interchanges data with a keyboard 287, an address decoder 288 and an address latch 289 which are driven by the CPU 284, a CGROM (Computer Graphics Read Only Memory) 285, a touch panel 210, and an LED driver 286. The CPU 284 interchanges addresses and data with, e.g., the address decoder 288 via the address latch 289, a ROM 290, an NVRAM (Non Volatile RAM) 291 and a system resetting 292.

Figures 5, 5A:
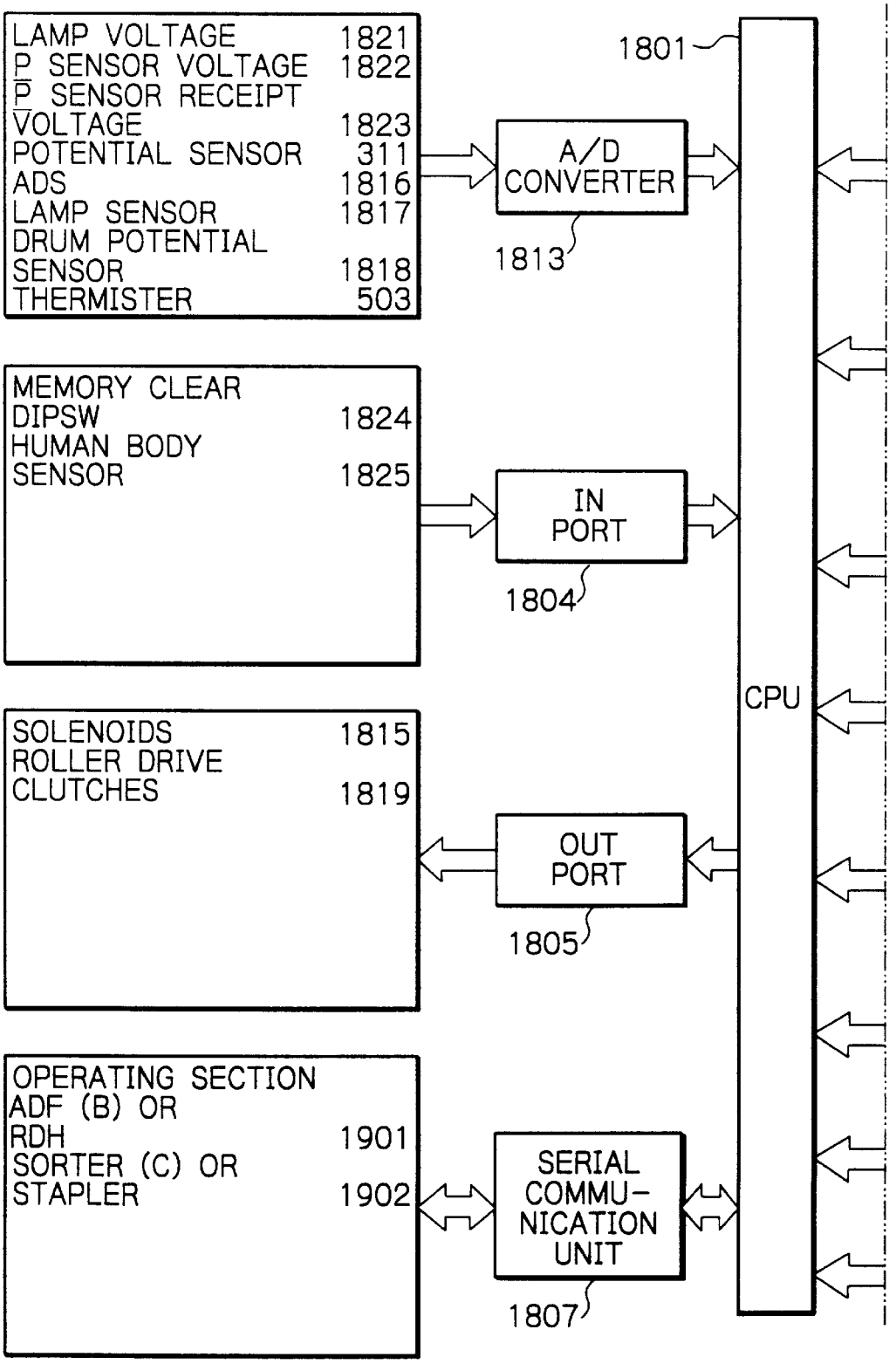
FIG. 5 is a schematic block diagram showing the functional arrangement of the illustrative embodiment.
Figure 5B:
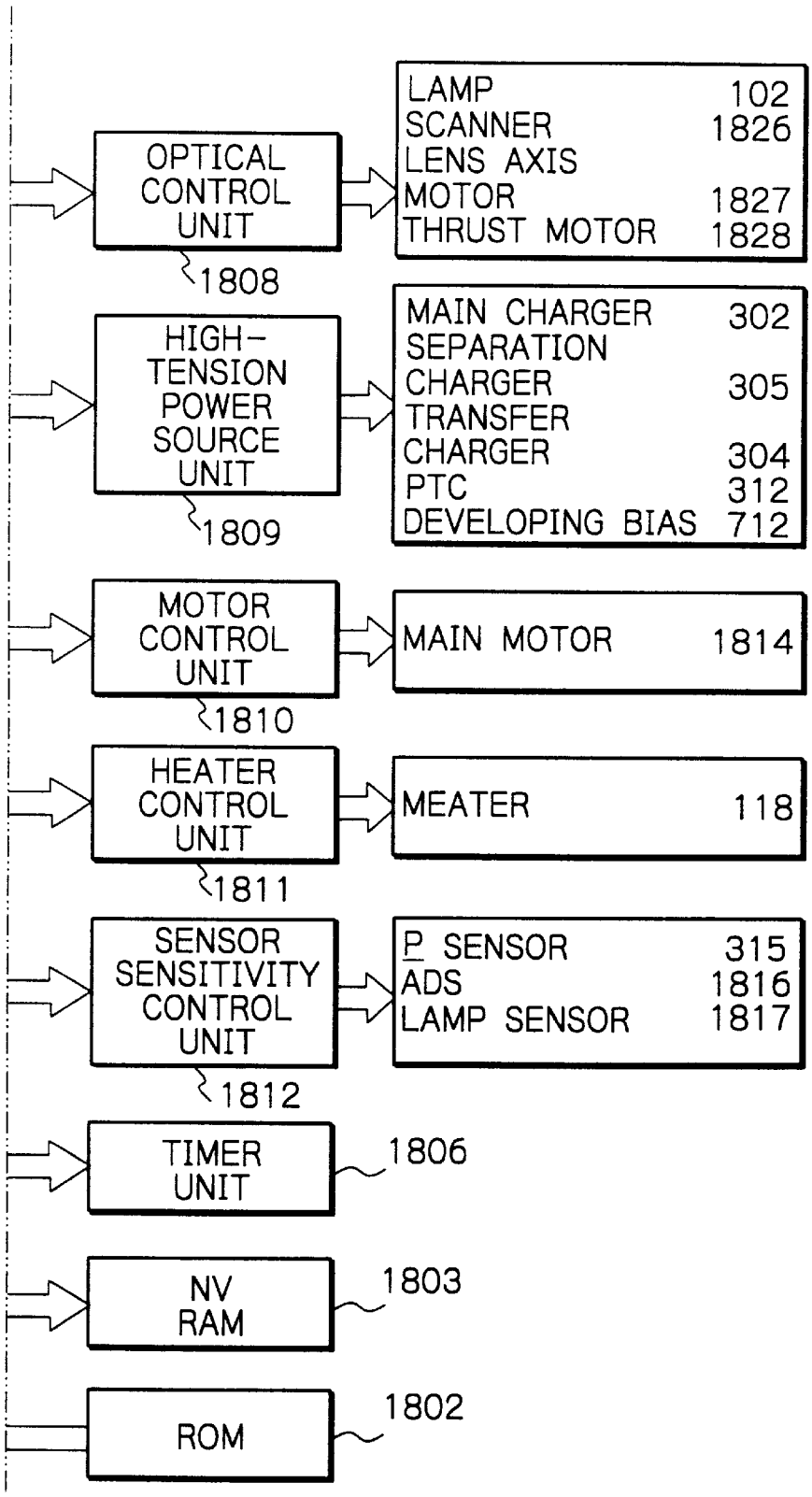

FIG. 5 shows the functional configuration of the copier 10. As shown, a CPU 1801 controls the entire copier body A on the basis of a control program and data. A ROM 1802 stores the control program beforehand. An NVRAM 1803 is backed up by a battery, not shown, and stores, e.g., the interim results of processing executed by the CPU 1901.

An IN (input) port 1804, an OUT (output) port 1805, a timer unit 1806, a serial communication unit 1807, an optics control unit 1808, a high-tension power source unit 1809, a motor control unit 1810, a heater control unit 1811, a sensor sensitivity control unit 1812 and an A/D (Analog-to-Digital) converter 1813 are connected to the CPU 1801. A memory clear DIPSW (Dip Switch) 1824 and a human body sensor 1825 are connected to the IN port 1804. Various solenoids 1815 and roller drive clutches 1819 are connected to the OUT port 1805. The operating section 200, automatic document feeding means (ADF) B or RDH (Recycling Document Handler) 1901 and the sorter C or a stapler 1902 are connected to the serial communication unit 1807.

The light source or lamp unit 102, a scanner 1826, a lens axis motor 1927 and a thrust motor 1828 are connected to the optics control unit 1808. The main charger 302, separation charger 305 and transfer charger 304 and a PTC (Pre Transfer Charger) 312 and a developing bias 712 are connected to the high-tension power source unit 1809. A main motor 1814 is connected to the motor control unit 1810. The fixing unit or heater 118 is connected to the heater control unit 1811. A P (Pattern) sensor or toner content sensor 315, an ADS (Automatic Density Sensor) 1816 and a lamp sensor 1817 are connected to the sensor sensitivity control unit 1812. Further, a lamp voltage 1812, a P sensor emission voltage 1822, a P sensor receipt voltage 1823, a potential sensor 311, the ADS 1816, the lamp sensor 1817, a drum current sensor 1818 and a thermistor 503 are connected to the A/D converter 1813.

The operation of the copier 10 will be described hereinafter. Mainly the CPU 1801 controls the copier body A on the basis of the control program and data stored in the ROM 1812. The CPU 1801 writes the interim results of processing in the NVRAM 1803. The outputs of the memory clear DIPSW 1824 and human body sensor 1825 are input to the CPU 1801 via the IN port 1804. The CPU 1801 sends control signals to the solenoids 1815 and roller drive clutches 1819 via the OUT port 1805. The timer unit 1806 counts time and is used to ON/OFF control an AC power source as a weekly timer. When the memory clear DIPSW 1824 is in its ON state at the time of power-up, preselected values are set in the NVRAM 1803.

The A/D converter 1813 digitizes the analog lamp voltage 1821, P sensor emission voltage 1822 and P sensor receipt voltage 1823 and the outputs of the potential sensor 311, ADS 1816, lamp sensor 1817, drum current sensor 1818 and thermistor 1817 and sends the resulting digital data to the CPU 1801. The high-tension power source unit 1809 feeds a particular high voltage to each of the main charger 302, separation charger 305, transfer charger 306, PTC 312, and developing bias 712.

The motor control unit 1810 controllably drives the main motor 1814. The sensor sensitivity control unit 1812 variably controls the gain of the lamp sensor 1817, the receipt gain of the ADS 1816, the receipt gain of the P sensor 315, and the emission voltage of the P sensor 315. The optics control unit 1808 controls the lamp unit 204 while the heater control unit 1811 controls the heater 118. The serial communication unit 1807 controls the interchange of commands between the CPU 1801 and the operating section 200, ADF B or RDH 1901, and sorter C or stapler 1902.

A copying operation unique to the illustrative embodiment is as follows. First, the operator inputs desired copying conditions including a magnification and image density and a desired number of copies on the operating section 200. If the operator does not need a trial copy, the operator presses the start key 205 so as to obtain the desired number of copies. If the operator selects the sort mode on the sort key 266 and then presses the start key 205, then the copier 10 outputs a desired number of sets of copies.

Assume that the operator desires to see the quality of a trial copy before causing the copier 10 to produce the desired number of copies at a time. Then, the operator presses the trial copy key 242 after inputting the various conditions on the operating section 200. In response, the ADF B feeds the first document to the glass platen 101, and a single paper is fed from any one of the paper trays 112, 113 and 114. As a result, a single trial copy is output in the preselected conditions. While the trial copy may be driven out to the sorter C if the sort mode has been selected, it may be driven out to a proof tray, not shown, face up for easy confirmation.

The above document fed to the glass platen 101 is held in a halt on the glass platen 101. The operator may vary the copying conditions on the operating section 200 and again touch the trial copy key 242. In response, another trial copy is produced with the document held on the glass platen 101. If the trial copy is acceptable, the operator presses the start key 205 so as to cause the copier 10 to start copying the document held on the glass platen 101.

The basic operation of the copier 10 will be described with reference to FIG. 6. As shown, whether or not a new job has been selected on the display 208 of the operating section 200 is determined (step S1). If the answer of the step S1 is positive (YES), the new job is set while a flag fSadf indicative of an SADF mode is reset (step S2). If the answer of the step S1 is negative (NO), the existing modes are maintained while the flag fSadf is hold in its set state.

In a step S3, whether or not the fSadf mode is set is determined on the basis of the flag fSadf. If the SADF mode is not set (NO, step S3), the trial copy key 242 is validated, e. g., the key 242 is displayed on the display 208 for allowing the operator to touch it (step S4). The operator touches the trial copy key 242 (step S11) and then touches the start key 205 (step S11).

When the trial copy key 242 is pressed (YES, step S5), trial copy processing beginning with a step S6 and ending with a step S10 being executed. Specifically, the trial copy key 242 is invalidated, e.g., it is caused to disappear from the display 208 (step S6). A document is fed from the ADF B to the glass platen (step S7), and then whether or not the SADF mode should be executed is determined (step S8).

Figure 7:
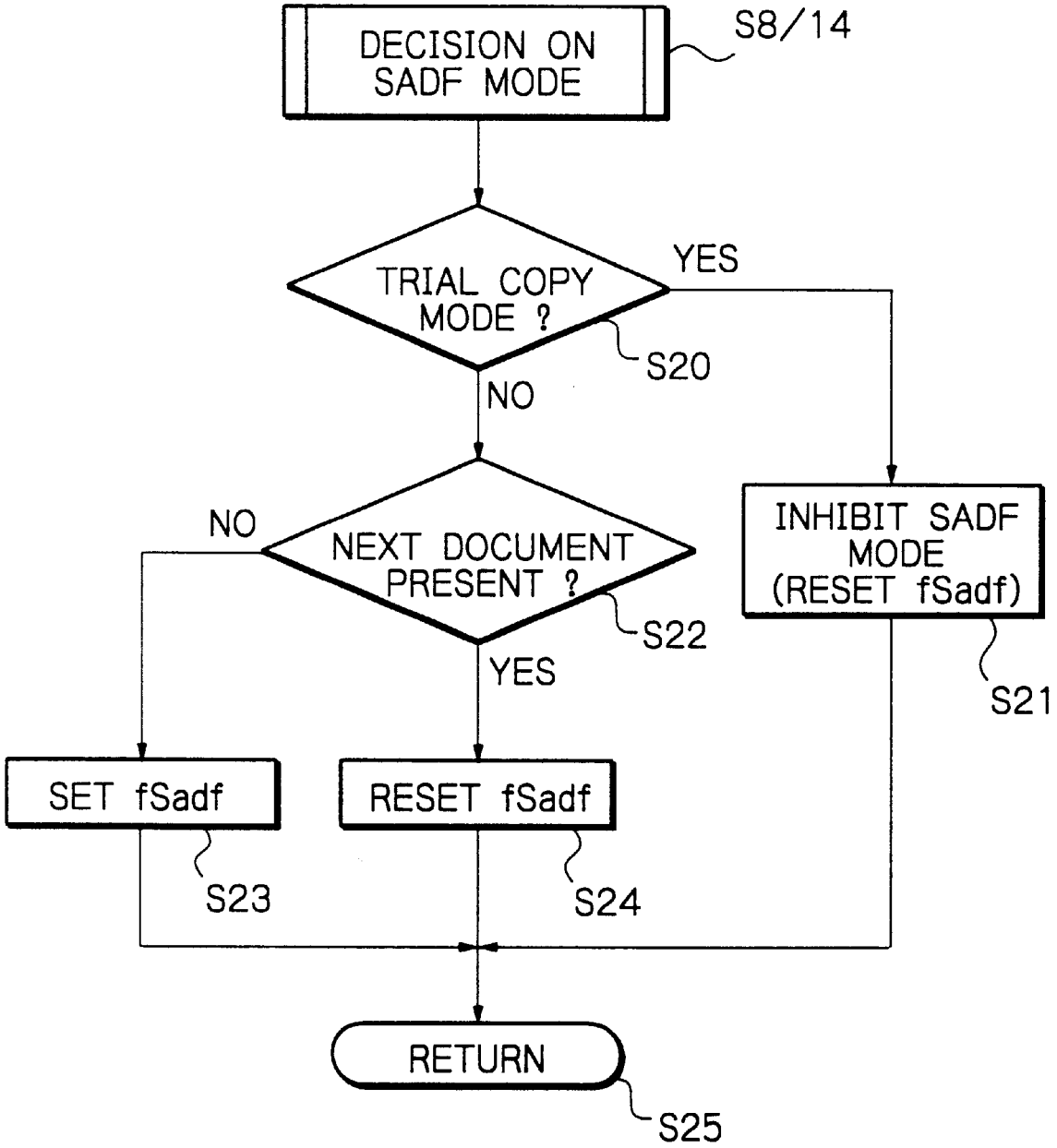
FIG. 7 is a flowchart representative of an SADF mode decision routine included in the flowchart of FIG. 6.

FIG. 7 shows the step or routine S8 in detail. As shown, if a trial copying operation is not under way (N0, step S20), whether or not the next document is present is determined on the basis of document feed information output in the step S6 or S13 (step S22). If the answer of the step S22 is YES, the flag fSadf is reset (step S24), and then the program returns (step S25). If the answer of the step S22 is NO, meaning that the next document is absent, the flag fsadf is set in order to execute the SADF mode (step S23).

If a trial copying operation is under way (YES, step 20), the flag fsadf is reset in order to inhibit the SADF mode (step S21).

The subroutine shown in FIG. 7 defines a basic configuration for obviating defective copies in an image forming apparatus operable in a trial copy mode. Further, assume that a single document is set on the automatic document feeding means in order to produce a trial copy in the SADF mode as in the usual copy mode. Then, as soon as the apparatus produces a copy with the above single document, it waits for the next document in the SADF mode. As a result, if the next document were set on the automatic document feeding means, the apparatus would generate a copy start command in the SADF mode and would start operating in the usual copy mode before the end of the trial copying operation, rendering the trial copy processing practically meaningless. This is why the subroutine of FIG. 7 inhibits the SADFmode while a trial copying operation is underway.

Moreover, inhibiting the SADF mode while a trial copying operation is under way is successful to obviate the following occurrence. Assume that the trial copy mode is such that after a trial copy has been output with a single document, the document is driven out of the glass platen. Then, as soon as the operator again sets the document on the automatic document feeding means, the apparatus starts copying it. To obviate this occurrence, the operator has to alter the existing copying conditions and then set the document on the automatic document feeding means; otherwise, a defective copy would be produced in the previous image forming conditions. That is, the operator has to be aware of the order of setting image forming conditions and setting a document, resulting in awkward operation.

Figure 8:
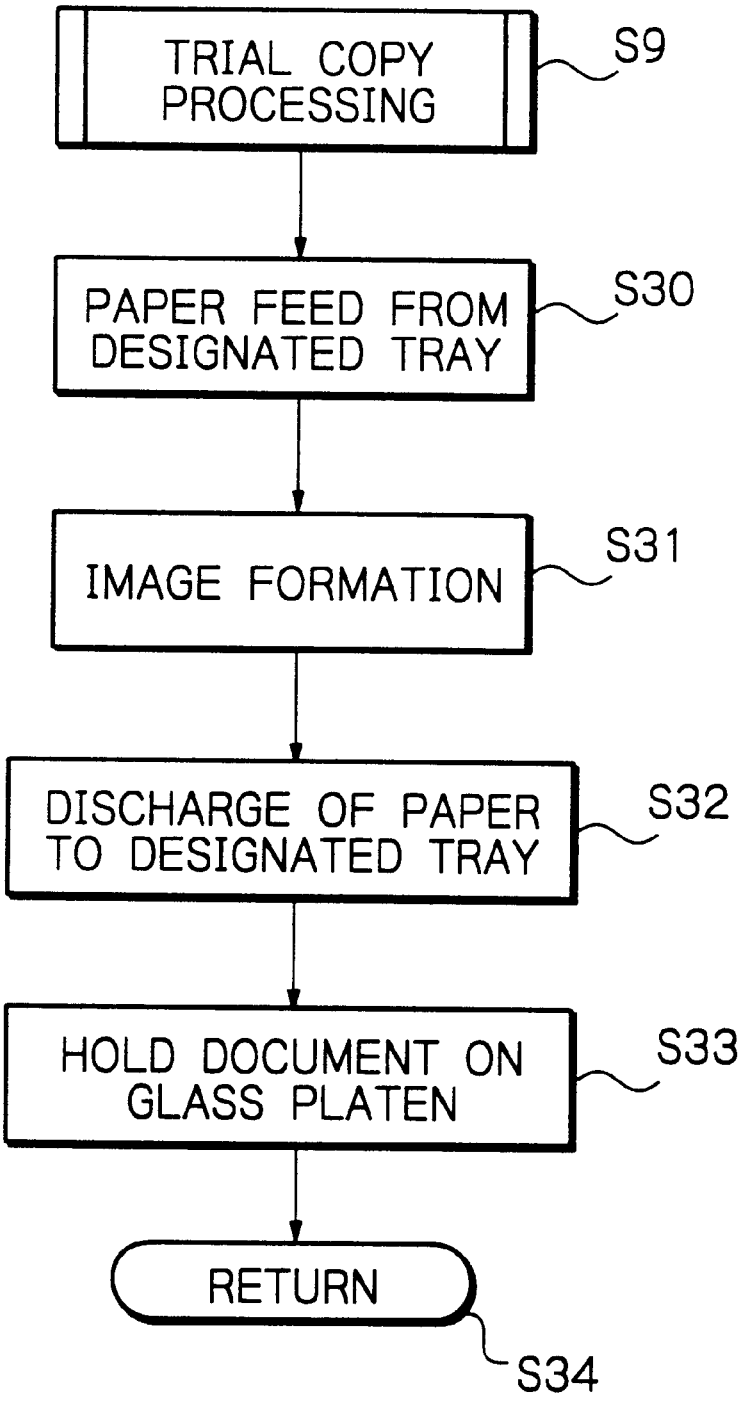
FIG. 8 is a flowchart representative of a copy processing routine also included in the flowchart of FIG. 6.

Referring again to FIG. 6, the step S8 is followed by a step S9 for executing trial copying. FIG. 8 shows a specific procedure for implementing the trial copying function. As shown, before producing a plurality of copies with the copier 10, the operator causes the copier 10 to produce a single trial copy in order to determine the quality of an image by eye (steps S30–S31). The trial copy is driven out to a preselected tray (step S32). The document to be copied later is held on the glass platen in order to prevent the operator from again stacking it (step S33).

Figures 6, 6A, 6B, 6C:
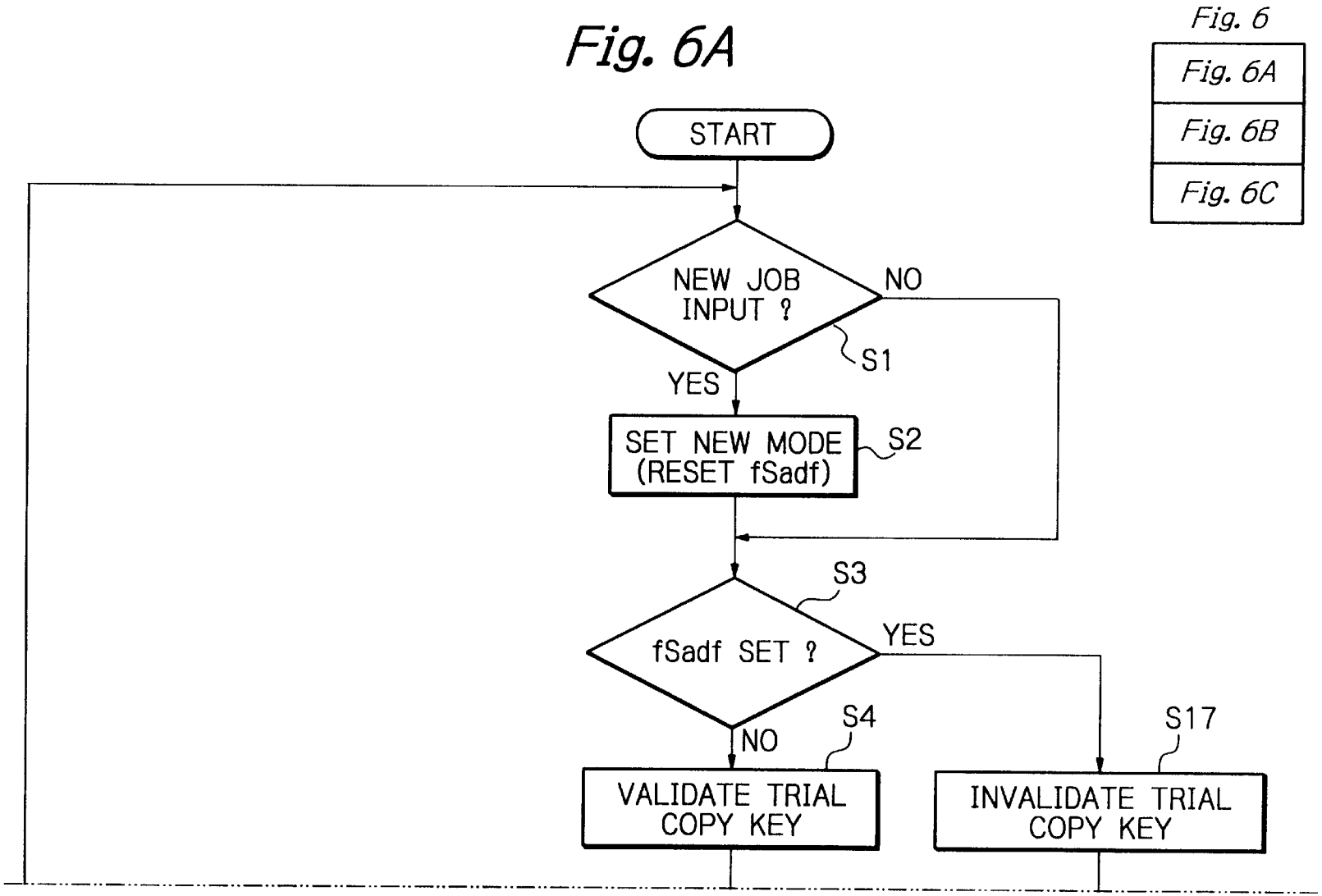
FIG. 6 is a flowchart demonstrating a specific operation of the illustrative embodiment.
Figure 6B:
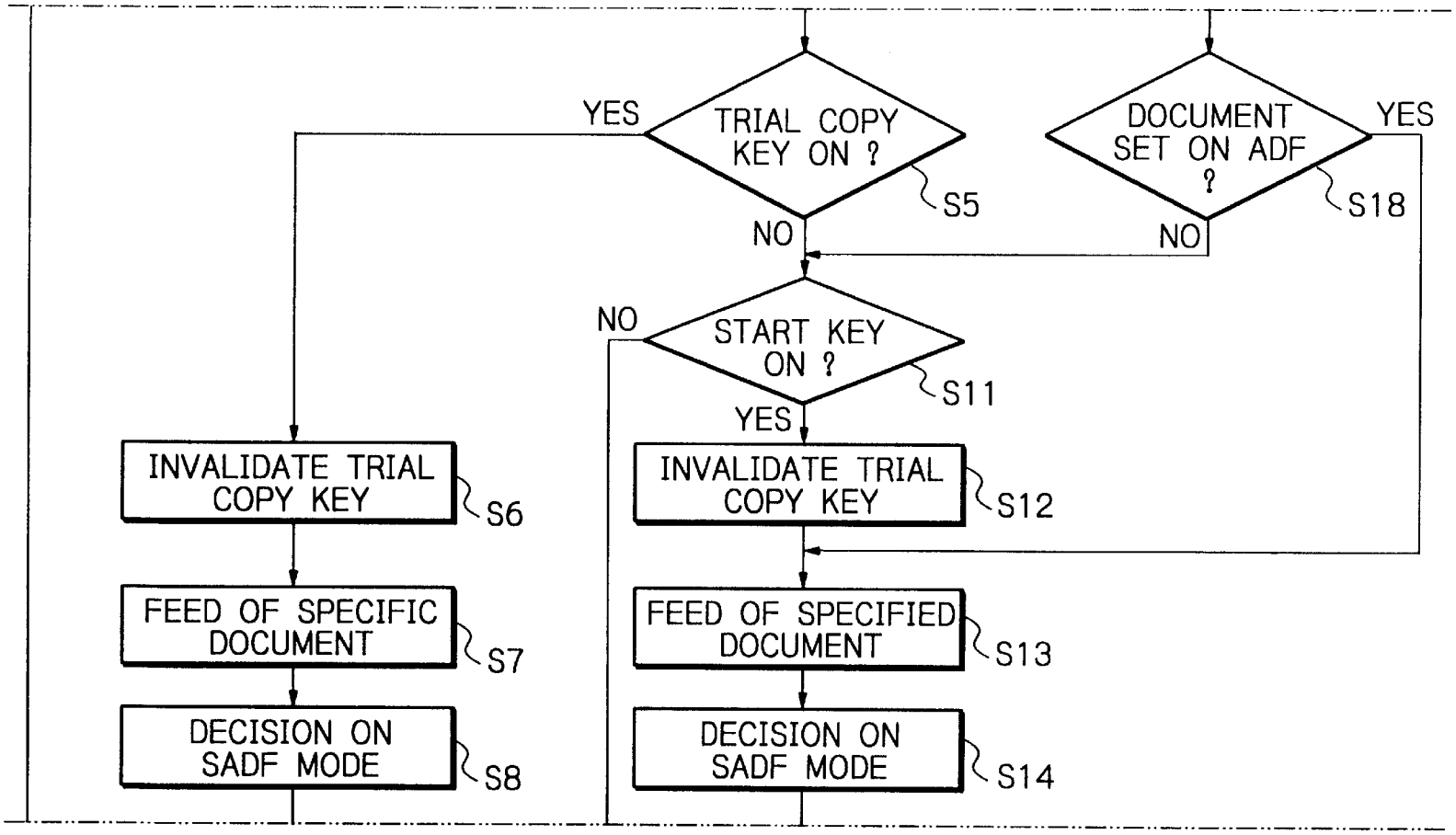
Figure 6C:
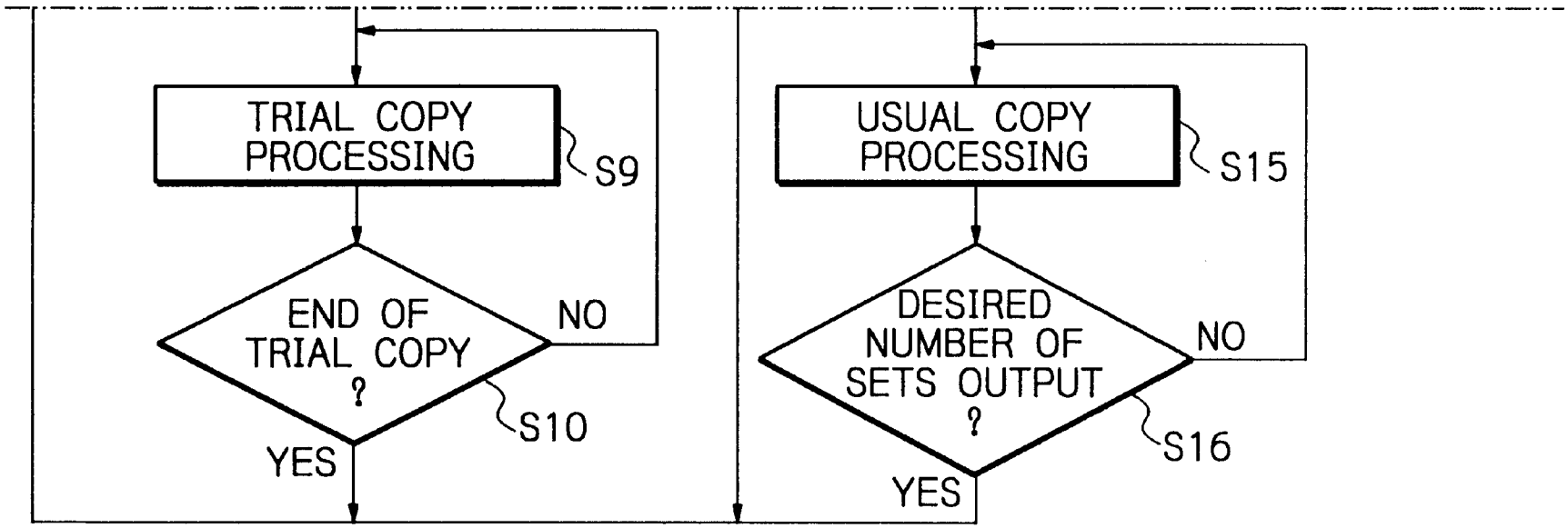

As shown in FIG. 6, whether or not the trial copy has been produced is determined (step S10). If the answer of the step S10 is YES, the program returns to the step S1. When the start key 205 is pressed (YES, step S11), steps S12–S16 are executed. The procedure represented by the steps S12–S16, except for the step S15, is identical with the trial copy procedure and will not be described in order to avoid redundancy. Even when a single document is copied in the usual copy mode, the SADF mode is inhibited due to the step S8.

However, when the operator determines the quality of the trial copy to be acceptable and again presses the start key 205 (non-trial copying), whether or not the SADF mode should be executed is again determined (step S14). At this time, the SADF mode is executed because a single document has been used for trial printing. That is, because the SADF mode is inhibited when a single document is set on the automatic document feeding means for producing a trial copy, the SADF mode can be restored as soon as the start key 205 is pressed after the inhibition.

Further, assume that the SADF mode is continuously inhibited after the production of the trial copy. Then, when the operator expecting the SADF mode sets a single document, the SADF mode is not available. In light of this, the SADF mode is again validated for the usual copy mode after the production of the trial copy. This allows the SADF mode inhibited in the trial copy mode to be restored when the start key 205 is pressed. The operator can therefore cause the copier to operate in desired modes including the trial copy mode.

As shown in FIG. 6, if the copying operation has completed (YES, step S16), and if the SADF mode is set with a single document (step S14; YES step S3), the next decision on a copy start is executed by steps S17 and S18. Specifically, in the case of the SADF mode, the trial copy key 242 is invalidated, e.g., the key 242 is caused to disappear from the display 208 (step S17). The key 242 is therefore invalidated while the SADF mode is under way. Subsequently, whether or not documents are present on the automatic document feeding means B is determined (step S18). If the answer of the step S18 is YES, the program triggers the SADF mode. If the answer of the step S18 is NO, whether or not the start key 205 is pressed is determined (step S11).

On the other hand, when the fixing temperature is short of a preselected temperature just after the power-up of the copier 10, the copier 10 inhibits the copying operation because a toner image cannot be surely fixed on a paper. As soon as the fixing temperature rises to the preselected temperature, the copier 10 cancels the inhibition. In such a case, the operator may set image forming conditions beforehand and touch the trial copy key 242 for a reserved trial copy. Then, as soon as the copier 10 cancels the above inhibition on the elapse of time, it starts producing a trial copy under the desired conditions immediately, as will be described hereinafter with reference to FIG. 9. This is the extension of a so-called auto start mode to trial copying.

Figure 9:
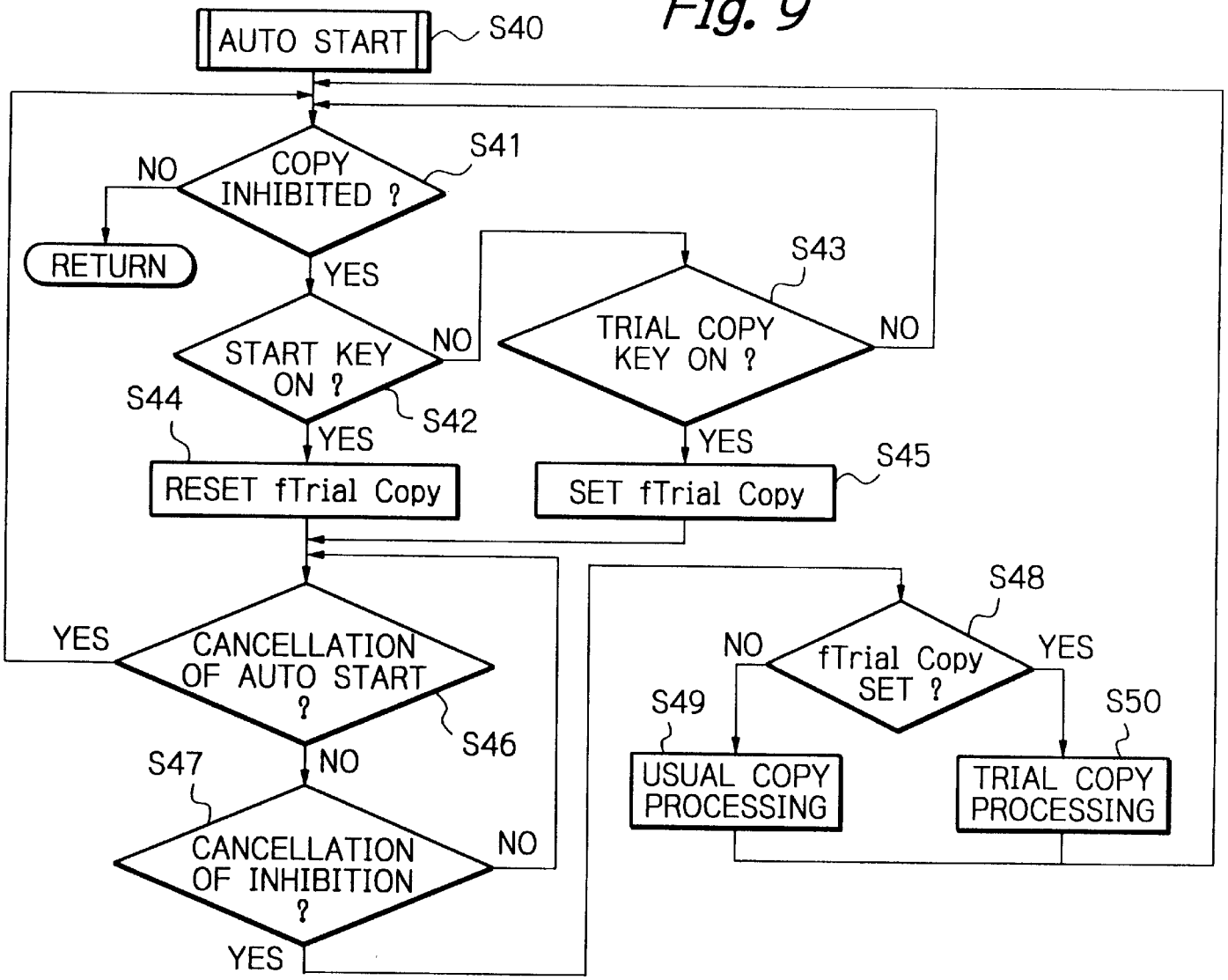
FIG. 9 is a flowchart representative of an auto start routine further included in the flowchart of FIG. 6.

As shown in FIG. 9, whether or not the copier 10 inhibits a copying operation (but will cancel the inhibition on the elapse of time) is determined (step S41). If the copier 10 is ready to operate (NO, step S41), the program returns. If the answer of the step S42 is NO because for, e.g., the fixing temperature is below the preselected temperature, whether or not a copying operation has been started on the start key 205 or the trial copy key 242 (stop S42) or whether or not a trial copy has been reserved (auto start) (step S43) is determined.

If a trial copy has been reserved (auto start) (YES, step S42), a flag fTrial Copy is set or reset (step S45 or S44) to show whether or not the reserved conditions are representative of usual copying or trial copying. Subsequently, whether or not the reserved trial copy (auto start) has been cancelled is determined (stop S46). If the answer of the step S46 is YES, the program returns to the step S41. If the answer of the step S46 is NO, the program waits until the copier 10 cancels the inhibition (step S47). For example, the copier 10 starts a copying operation as soon as it cancels the above inhibition. In a step S48, which of usual copying (step S49) and trial copying (step S50) should be executed is determined.

As stated above, the procedure of FIG. 9 is practicable with exclusive copy start reserving means (auto start) for the trial copy mode for causing, when the copier 10 is unable to operate, the operation to start automatically on the cancellation of the inhibition. This makes it needless for the operator to just stand by the copier 10 until the copier 10 becomes ready to operated, and then press the trial copy key 242. The operator can therefore operate the copier 10 more easily in the trial copy mode.

In summary, it will be seen that the present invention provides an image forming apparatus having various unprecedented advantages, as enumerated below.

(1) In an image forming apparatus operable in atrial copy mode, there is defined a basic configuration for obviating defective copies in the SADF mode.

(2) Assume that a single document is set on automatic document feeding means in order to produce a trial copy in the SADF mode as in the usual copy mode. Then, as soon as the apparatus produces a copy with the above single document, it waits for the next document in the SADF mode. As a result, if the next document were set on the automatic document feeding means, the apparatus would generate a copy start command in the SADF mode and would start operating in the usual copy mode before the end of the trial copying operation, rendering the trial copy processing practically meaningless. To solve this problem, the apparatus of the present invention inhibits the SADF mode while a trial copying operation is under way.

(3) Inhibiting the SADF mode while a trial copying operation is under way is successful to obviate the following occurrence. Assume that the trial copy mode is such that after a trial copy has been output with a single document, the document is driven out of the glass platen. Then, as soon as the operator again sets the document on the automatic document feeding means, the apparatus starts copying it. To obviate this occurrence, the operator has to alter the existing copying conditions and then set the document on the automatic document feeding means; otherwise, a defective copy would be produced in the previous image forming conditions. That is, the operator has to be aware of the order of setting image forming conditions and setting a document, resulting in awkward operation.

(4) The SADF mode is inhibited when a single document is set on the automatic document feeding means for producing a trial copy. Therefore, when a start key pressed after the inhibition, the SADF is restored and can be resumed.

(5) Assume that the SADF mode is continuously inhibited after the production of the trial copy. Then, when the operator expecting the SADF mode sets a single document, the SADF mode is not available. In light of this, the SADF mode is again validated for the usual copy mode after the production of the trial copy. This allows the SADF mode inhibited in the trial copy mode to be restored when the start key 205 is pressed. The operator can therefore cause the copier to operate in desired modes including the trial copy mode.

(6) The trial copy key is invalidated while the SADF mode operation is under way.

(7) Even during SADF mode operation, the automatic document feeding means can wait for a document. By opening the automatic document feeding means, setting a document on the glass platen and then closing the document feeding means, it is possible to cancel the SADF state. Further, when a document is absent on the glass platen, the apparatus does not produce a wasteful trial copy on which only the surface of a belt conveyor is reproduced. That is, the apparatus inhibits the trial copy mode beforehand and thereby obviates the wasteful consumption of papers and energy.

(8) When the fixing temperature is below a preselected temperature just after the power-up of the apparatus, the apparatus inhibits the copying operation because a toner image cannot be surely fixed on a paper. As soon as the fixing temperature rises to the preselected temperature, the apparatus cancels the inhibition. In such a case, the operator may set image forming conditions beforehand and touch the trial copy key for a reserved trial copy. Then, as soon as the apparatus cancels the above inhibition on the elapse of time, it starts producing a trial copy under the desired conditions immediately.

(9) The apparatus is operable with exclusive copy start reserving means for the trial copy mode. When the apparatus is unable to operate, it causes the operation to start automatically on the cancellation of the inhibition. This makes it needless for the operator to just stand by the apparatus until the apparatus becomes ready to operated, and then press the trial copy key. The operator can therefore operate the apparatus more easily in the trial copy mode.

Various modifications will become possible for those skilled in the art after receiving the teachings of the present disclosure without departing from the scope thereof.

What is claimed is:

1. An image forming apparatus comprising:

trial copy mode means for executing a trial copy mode for forming a document image on a recording medium in set conditions at least once and discharging said recording medium to a preselected destination;

automatic document feeding means positioned above a glass platen mounted on a body of said image forming apparatus for automatically feeding a document to said glass platen;

first copy starting means including a start key for commanding a start of a copying operation or a trial copy key for commanding an execution of said trial copy mode;

second copy starting means for determining, in response to a copy start command output from said first copy starting means, whether or not the document set on said automatic document feeding means is a single document and executing, if said document is a single document and when a next document is set after said document, an SADF mode for starting copying said next document after said single document even if said start key is not pressed; and control means for inhibiting, while the SADF mode is under way, an acceptance or an execution of said trial copy mode using said first copy starting means.

2. An image forming apparatus, comprising:

an operating section configured to receive operating commands and image forming parameters set by an operator, comprising, a start key configured to initiate a copying operation, and a trial copy key configured to initiate a trial copy mode wherein respective images of a first document are formed onto a recording medium in accordance with the image forming parameters set by the operator and are discharged to a preselected destination in order for the operator to inspect the respective images prior to copying subsequent documents;

an automatic document feeder positioned above a glass platen, including a semi-automatic document feed mechanism, and configured to operate in a semiautomatic document feed mode irrespective of whether the first document is the only document set on said automatic document feeder, wherein subsequent documents are automatically copied upon being set on said automatic document feeder; and a controller configured to control implementation of the trial copy mode and the semiautomatic document feed mode, wherein in response to the initiation of a copying operation, said semiautomatic document feed mode is inhibited by said controller when the trial copy mode is in effect.

3. An apparatus as claimed in claim 2, further comprising control means for validating, when the copy start command is output from said first copy starting means after the execution of said trial copy mode, an operation of said second copy starting means.

4. An apparatus as claimed in claim 2, wherein said controller is further configured to control said operating section to display operating commands indicative that said semiautomatic feed mode is not inhibited after the execution of said trial copy mode.

5. An image forming apparatus, comprising:

a main controller configured to control implementation of a trial copy mode wherein a document image is formed onto a recording medium in accordance with image forming parameters set by an operator and is discharged to a preselected destination in order for the operator to inspect the document image prior to completing a copying operation, comprising, a first controller configured to initiate a copying operation immediately upon detecting a transition from an unable-to-copy state in which the image forming apparatus is in a fault condition to an able-to-copy state during the trial copy mode, and a second controller configured to initiate the trial copy mode immediately upon detecting a cancellation of the unable-to-copy state.

* * * * *